United States Patent [19]

Sugiyama et al.

[11] Patent Number: 4,780,090

[45] Date of Patent: Oct. 25, 1988

[54] ULTRA MULTI-POLE CONNECTOR

[75] Inventors: Masaaki Sugiyama; Mitsugu Watanabe; Hideharu Hayashi; Yukio Nishio; Masaki Yamamoto, all of Shizuoka, Japan

[73] Assignee: Yazaki Corporation, Japan

[21] Appl. No.: 66,111

[22] Filed: Jun. 25, 1987

[30] Foreign Application Priority Data

Jun. 25, 1986 [JP] Japan ..... 61-95941[U]

[51] Int. Cl.[4] ..... H01R 13/64

[52] U.S. Cl. ..... 439/247; 439/686

[58] Field of Search ..... 439/246–252, 439/374, 376, 640, 686, 695, 701, 712, 713, 717

[56] References Cited

U.S. PATENT DOCUMENTS

| | | | |
|---|---|---|---|
| 2,438,371 | 3/1948 | Marholz | 439/247 |
| 3,397,384 | 8/1968 | Lawrence | 439/246 |
| 3,440,596 | 4/1969 | Frompovicz | 439/695 |
| 3,562,696 | 2/1971 | Barnhart et al. | 439/248 |
| 4,109,993 | 8/1978 | Bauerle | 439/695 |
| 4,469,393 | 9/1984 | Chewning, Jr. et al. | 439/717 |
| 4,484,792 | 11/1984 | Tengler et al. | 439/701 |
| 4,596,436 | 6/1986 | Kraemer et al. | 439/686 |
| 4,627,759 | 12/1986 | Kato et al. | 403/2 |

FOREIGN PATENT DOCUMENTS

| | | | |
|---|---|---|---|
| 1542972 | 3/1979 | United Kingdom | 439/717 |

*Primary Examiner*—Gil Weidenfeld
*Assistant Examiner*—Gary F. Paumen
*Attorney, Agent, or Firm*—Wigman & Cohen

[57] ABSTRACT

An ultra multi-pole connector includes a plurality of small size multi-pole connectors each having a connector housing which has a plurality of terminals connected to a plurality of wires therein and engagement shoulders projecting from the upper portion of the connector housing, and a casing having a plurality of hollow sections to which said small size multi-pole connectors are mounted, respectively, and each of said hollow section having an engagement members, thereby the small size multi-pole connectors can be displaceably mounted in the hollow sections by engagement of the engagement shoulders and the engagement members.

9 Claims, 4 Drawing Sheets

ULTRA MULTI-POLE CONNECTOR

FIELD OF THE INVENTION

This invention relates to an ultra multi-pole connector, in particular to an ultra multi-pole connector for use in electrical connection of wire-harnesses to electrical equipment.

DESCRIPTION OF THE PRIOR ART

Recently, the number of wires bundled in a wire-harness which is used for electrical connection in automobiles or the like has increased remarkably in accordance with increased diversification of the electrical equipment used in the automobiles. Under the circumstances, conventionally, a plurality of small size connectors were attached to each group of wires in the wire-harness to connect it to an electrical equipment, so that the number of the connectors also tends to increase as the number of the wires increases.

However, the increase in the number of the connectors results in problems such as requiring more time for and making connection for disconnection between the wire-harness and the electrical equipment more difficult as well as requiring a large space for equipment.

In order to overcome these problems, an ultra multi-pole connector having a large number of terminals has been developed, as shown in FIG. 1. Said conventional ultra multi-pole connector 1 includes a connector housing 2 having a large number of terminals therein, which is fitted to a mating connector 3 also having a large number of terminals. Further, since many terminals have to be fitted to each other to connect the connector 1 to the mating connector 3, large force is required for the connection or disconnection therebetween. Therefore, the ultra multi-pole connector 1 was connected to the mating connector 3 by screwing a bolt 4 provided in the connector 1 through a bolt holder to a nut 5 provided in the partner connector 3 thorough a nut holder with a wrench 6.

In the conventional multi-pole connector 1, however, there was the disadvantage that dimensional tolerance in the arrangements of the terminals in the connector 1 has to be smaller than that of the conventional small size connector since it is required that arrangement of the many terminals in the connector 1 conform with those of the terminals in the mating connector 2 accurately in order to avoid collisions between the terminals in the connector 1 and the mating connector 2 when they are fitted to one other. Therefore, it is required for the conventional multi-pole connector e.g. to improve accuracy of the die used for manufacturing the connector, to use new resin materials having a small coefficient of mold shrinkage for the connector housing, or to use various spacers for correcting displacement of terminals, and so forth. In this case, it is also difficult to keep the quality of parts used in the connector consistant.

Further, there were disadvantages in the conventional ultra muti-pole connector 1 in that operation efficiency when wires are connected to the terminals deteriorates due to twisting of the wires, and such twisting is liable to cause mis-insertion of the terminals. Furthermore, if the size or kind of the automobile in which the connector is used is changed, there may be a case in which not all terminals in the connector 1 are used for electrical connection due to the number of terminals in the mating connector 2 being small. In that case, the non-used terminals are wasted, resulting in inefficiency.

SUMMARY OF THE INVENTION

In view of the foregoing disadvantages, this invention has been made. Accordingly, a main object of the present invention is to provide an ultra multi-pole connector which can absorb dimensional tolerance between the connector and a mating connector, so that connection and disconnection of them can be easily accomplished.

Another object of the present invention is to provide an ultra multi-pole connector which can be connected to the mating connector easily without causing collisions between the terminals of the connectors.

Still another object of the present invention is to provide an ultra multi-pole connector in which the number of the terminals in the connector can be easily increased or decreased so as to conform to the number of terminals in the mating connector.

Yet another object of the present invention is to provide an ultra multi-pole connector which does not require a high accuracy in the parts, manufacturing and assembly thereof.

In order to attain the above-objects, the ultra multi-pole connector according to the present invention comprises a plurality of small size multi-pole connectors each having a connector housing which has a plurality of terminals connected to a plurality of wires therein, a casing having a plurality of hollow sections in which said small size multi-pole connectors are inserted, respectively, and means for displaceably mounting each of said small size multi-pole connectors in the respective hollow sections.

According to the present invention having the above structure, since a plurality of multi-pole connectors are displaceably mounted in the casing, the deviation between the connectors can be easily absorbed, so that it becomes unnecessary to prepare such a high dimensional accuracy for arrangements of the terminals as previously required, a specific die used for manufacturing the connector and specific resin materials for the connector housing.

Further, since the ultra multi-pole connector of the present invention includes a plurality of small connectors and a casing having a plurality of hollow sections in which one of said small connectors is inserted, the number of the terminals can be easily increased or decreased in accordance with the number of terminals in a mating connector by increasing or decreasing the number of the small size connectors, so that this connector can be utilized in any kind of automobiles.

Furthermore, operation efficiency when wires are attached to the terminals is also improved.

These and other objects and advantages of the present invention, as well as the details of illustrative embodiments, will be more fully understood from the following specification and drawings, in which;

DETAILED DESCRIPTION OF THE PREFERRED EMBODIMENT

Figure 1:
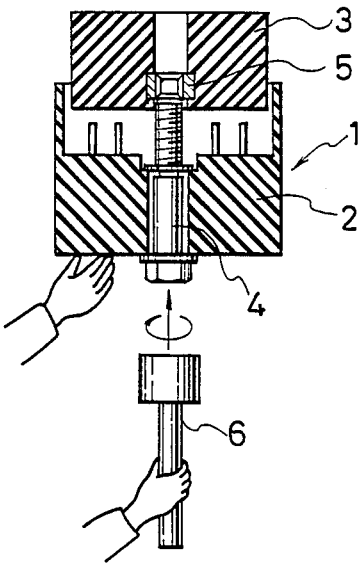
FIG. 1 PRIOR ART
FIG. 1 is a sectional view of a conventional multi-pole connector.

Referring now to the drawings, preferred embodiments of the present invention will be described.

Figure 2:
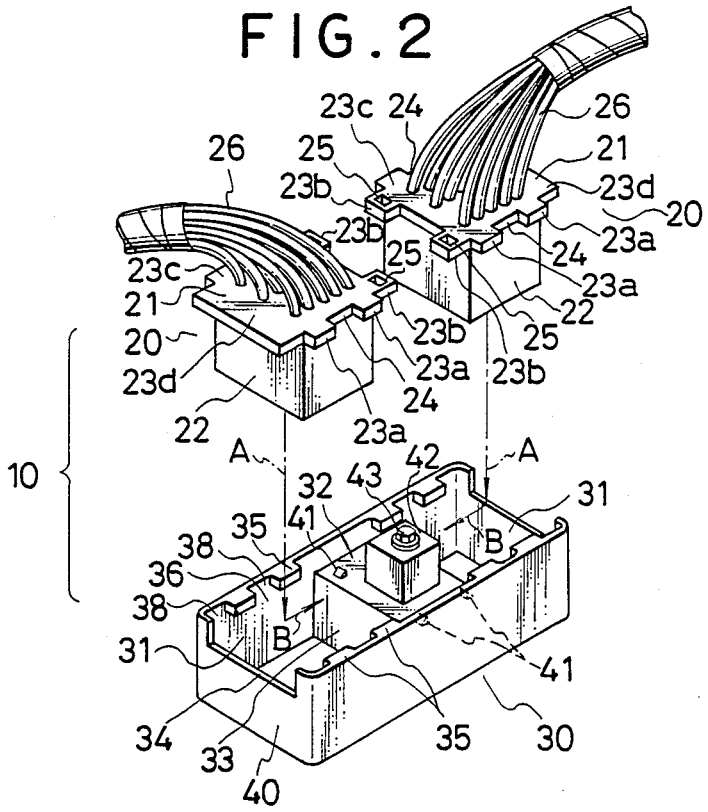
FIG. 2 is a disassembled perspective view of one embodiment of an ultra multi-pole connector according to the present invention.

FIG. 2 is a disassembled perspective view of the first embodiment of an ultra multi-pole connector of the present invention. In the drawing, the ultra multi-pole connector 10 comprises two small size multi-pole connectors 20 and a casing 30 in which said connectors 20 are displaceably mounted.

Each of said small size multi-pole connectors 20 is an ordinarily used type of a multi-pole connector which has a plurality of terminal accommodating rooms therein (not shown) and a plurality of wires connected thereto. Specifically, said small size multi-pole connector comprises an upper plate portion 21 having a substantially square shape, a connector housing 22 having a substantially square shape in cross section and including a plurality of terminals which are accommodated in the terminal accommodating room, and a plurality of wires 26 connected to the terminals in the housing 22. In addition, said small size multi-pole connector 20 further comprises engagement shoulders 23*a*, 23*b*, 23*c* and 23*d* formed on each edge of the upper plate portion 21 of the connector 20, which are projected perpendicular to each side surface of the housing 22. Said engagement shoulders 23*a* and 23*c* includes two projections disposed with a space 24 therebetween, respectively. In the engagement shoulder 23*b*, which also includes two projections, there are provided engagement apertures 25, respectively.

Said casing 30 comprises a hollow frame having a rectangular shape in cross section as shown in FIG. 2. In the casing 30 at the center portion thereof, there is provided a central partition stepped section 32. Said stepped section 32 divides the inside of the casing 30 into two substantially square shaped hollow sections 31 in which said small size multi-pole connectors 20 are displaceably accommodated, respectively.

Figure 3:
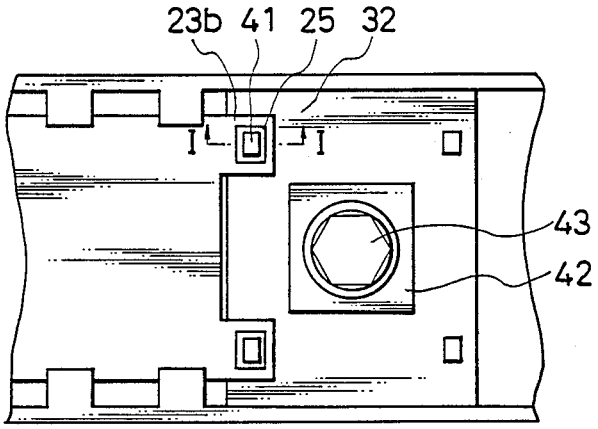
FIG. 3 is an enlarged partial plan view of the ultra multi-pole connector of FIG. 2.
Figure 4:
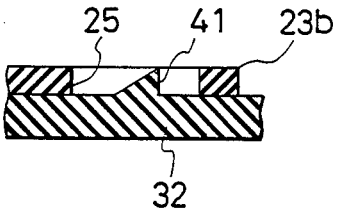
FIG. 4 is a sectional view taken on line I—I of FIG. 3.

As shown in FIGS. 3 and 4, on the upper surface of the stepped section 32, there are provided two inclined projections 41 which are adapted to be in engagement with the engagement apertures 25 of the engagement shoulder 23*b* on the opposite sides of the upper surface of the stepped section 32, respectively. The size of the projection 41 is smaller than that of the aperture 25 of the engagement shoulder 23*a*. On the stepped section 32, there is provided a bolt holder 42 having a fitting bolt 43 to be screwed into a nut provided in a partner connector (not shown).

Notches 34 are formed on side surfaces 40 of the hollow sections 31 which are located at the opposite side to each side wall 33 of the stepped section 32, respectively. Each of said notch 34 is formed by cutting the upper portion of the side surface 40 concavely. The width of the notch 34 corresponds to that of the engagement shoulder 23*d*, and the height of the edge of the notch 34 corresponds to that of the upper surface of the stepped section 32.

Further, engagement members 35 are formed on the upper ends of the lateral surfaces 36 of each hollow section 31 which are located on both sides of the side wall 33 of the stepped section 32. Each of said engagement members 35 comprises two projections protruding inwardly. The projections are disposed with spaces 38 such that the projections of the engagement shoulders 23*a* or 23*b* can be pass through the spaces 38. Further, the distance between the lower surface of the engagement member 35 and the upper surface of the stepped section 32 is set to be substantially equivalent to the thickness of the engagement shoulder 23*a* and 23*c*. Furthermore, the distance between the tops of the engagement shoulders 23*a* and 23*c* is slightly shorter than the distance between the inner walls of the lateral surface 36. As a result, the small size multi-pole connectors 20 are mounted in the hollow sections 31 displaceably in the horizontal directions in the condition that the engagement members 35 are abutted on the engagement shoulder 23*a* and 23*c*, respectively, the engagement shoulder 23*b* is abutted on the stepped section 32 with the engagements of the engagement apertures 25 and the inclined projections 41, and the engagement shoulder 23*d* is abutted on the notch 34, respectively.

Figure 5:
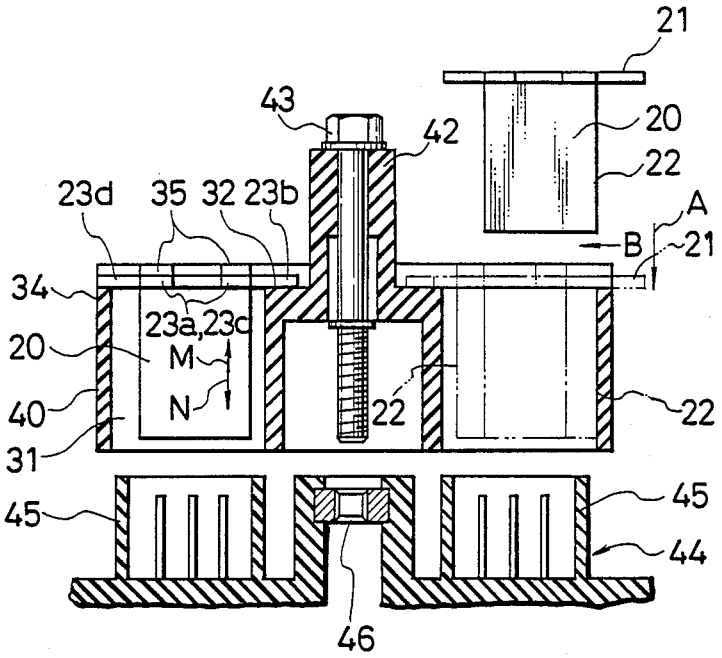
FIG. 5 is a disassembled sectional view of the ultra multi-pole connector of FIG. 2.

Hereinafter, the manner of mounting the small size multi-pole connector 20 to the casing 30 of an ultra multi-pole connector is explained. First, a plurality of terminals to which a plurality of wires are connected, respectively, are attached to each small size multi-pole connector 20 by means of a conventional method. Thus-prepared connectors 20 are inserted in the hollow sections 31 from the direction as indicated by lines A in FIGS. 2 and 5, respectively. Then, each connector 20 is inserted into the respective hollow section 31, such that a side wall of connector housing 22 which is located on the side of the engagement shoulder 23*d* is slidably contacted with the inner wall of the side surface 40. Then, the projections of the engagement shoulder 23*a* and 23*c* pass through the spaces 38, and the engagement shoulder 23*d* is abutted to the notch 34 and the engagement shoulder 23*b* is abutted on the upper surface of the stepped portion 32. This state is indicated with a chain line in FIG. 5. Thereafter, the small size multi-pole connectors 20 are moved toward the stepped portion 32, which direction is indicated by lines B, so that the apertures 25 are in engagement with the projections 41, respectively.

In this state, the engagement shoulders 23*a* and 23*c* are contacted with the under surfaces of the engagement members 35, thereby being able to absorb an external force acting in the direction of M, which corresponds to an force acting when the ultra multi-pole connector 10 is attached to the mating connector 44. In addition, the engagement of the engagement shoulder 23*d* and the notch 34 and the engagement of the engagement shoulder 23*b* and the upper surface of the stepped section 32 function so as to absorb an external force acting in the direction of N, which corresponds to the force acting when the ultra multi-pole connector 10 is withdrawn from the mating connector 44.

Thus-assembled connector 10 is connected to the mating connector 44 with the bolt 43 provided on the bolt holder 42 which is to be screwed to a nut 46 provided in the partner connector 44, whereby female terminals and male terminal provided in the connectors, respectively, are connected to each other, so that electrical connection between the connectors can be attained. In this case, the mating connector 44 also has two small size connectors 45 to which the small size multi-pole connectors 20 are connected, respectively.

Figures 6A, 6B, 6C:
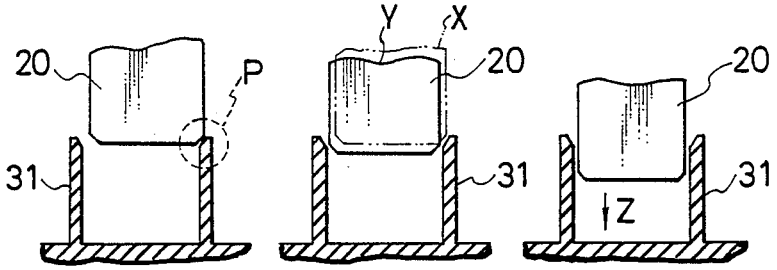
FIGS. 6(A), (B), and (C) are diagrams showing the condition that a deviation between the connector and a mating connector is absorbed.

According to the connector having the construction described above, if there is deviation P between the small size multi-pole connector 20 and partner connector, the deviation P is easily corrected by displacing the position of the small size multi-pole connectors 20 from the position represented by a chain line X to the position by a solid line Y, as shown in FIGS. 6(A), (B), so that the connector 20 is inserted toward the direction represented by the arrow Z in FIG. 6(C) easily.

Figure 7:
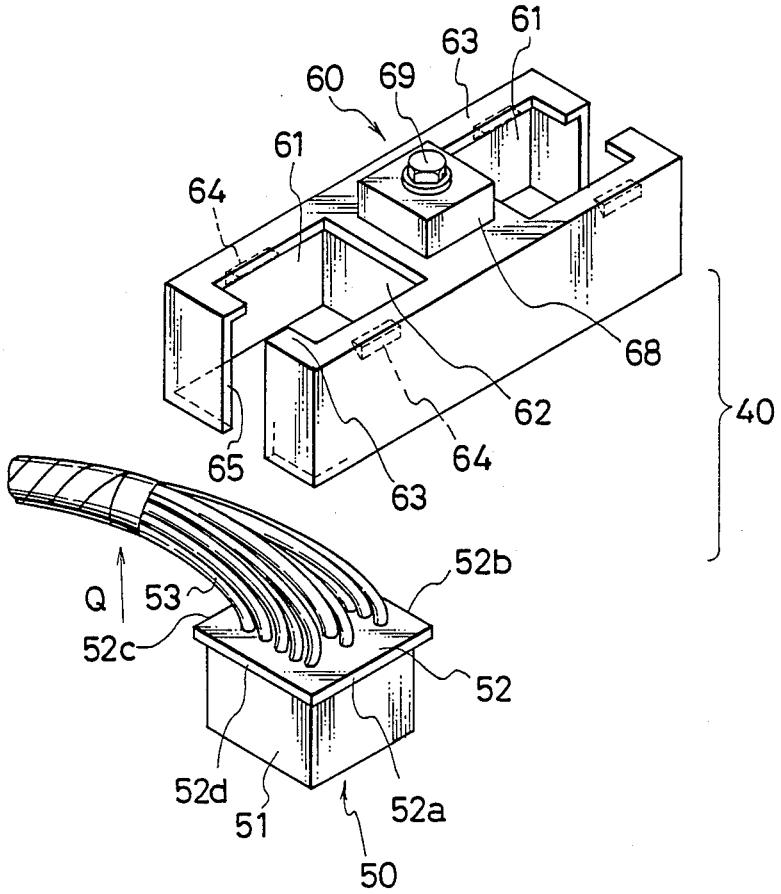
FIG. 7 is a disassembled perspective view of an additional embodiment of an ultra multi-pole connector according to the present invention.

FIG. 7 shows an additional embodiment of an ultra multi-pole connector of the present invention. In this embodiment, the connector includes two small size multi-pole connectors 50 and a casing 60. Each connector 50 comprises a connector housing 51 having a substantially square shape in cross section and an upper plate 52 having a substantially square shape. An area of the upper plate 52 is larger than the cross sectional area of the housing 51, so that engagement shoulders 52*a*, 52*b*, 52*c* and 52*d* are formed therearound, respectively. In the housing 51, there are accommodated a plurality of terminals (not shown) to which a plurality of wires 53 are connected.

On the other hand, said casing 60 comprises a hollow frame having a substantially rectangular shape in cross section. At the center portion thereof, there is provided a partition section 62 which defines, inside of the casing 60, two hollow sections 61 having a substantially square shape in cross section. The size of the cross sectional area of the hollow section 61 is slightly larger than that of the upper plate 52 of the connector 50, so that the small size multi-pole connector 50 can be moved in the hollow section 61 displaceably. Around the upper portion of each hollow section 61, there is provided engagement portion 63 which can be engagement with the engagement shoulders 52*a*, 52*b*, 52*c* and 52*d*. Said engagement portion 63 is formed by extending the upper portion of the hollow section 61 inwardly. On lateral surfaces 64 of the hollow section 61, there are provided engagement pieces 64 and 64, respectively, for engaging the engagement shoulders 52*a* and 52*c*, thereby the connector 50 being mounted in the hollow section 61 displaceably in the horizontal directions.

On the center partition section 62, there is provided a bolt holder 68 on which a bolt 69 is mounted. Further, on the side surfaces 66 of the hollow section 61 which are located on the opposite sides of the partition section 62, there are provided longitudinal slits 65 in which the wires 53 connected to the connector 50 is passed to equip the connectors 50 in the hollow sections 61, respectively.

In this embodiment, each small size multi-pole connectors 50 is inserted into the hollow sections 61 along with the line indicated by an arrow Q and mounted in the hollow section 61 displaceably in the horizontal direction by engaging the engagement shoulders 52*a* and 52*c* between the under surface of the engagement portions 63 and the engagement pieces 64, respectively. Therefore, it is possible for the ultra multi-pole connector of this embodiment to have the same operation and result as those of the ultra multi-pole connector of the first embodiment.

These embodiments are two of exemplified examples which have only two small size multi-pole connectors, respectively. However, it may be possible to have small size multi-pole connectors which number three or more. In this case, one of the connectors may be integrally mounted in the casing in advance.

According to the ultra multi-pole connector described above, since an ultra multi-pole connector is assembled from two small size multi-pole connectors and each small size multi-pole connector is constructed to be displaceable in the casing of the connector, the deviation between the connector and a mating connector can be absorbed when the connectors are fitted to each other. Therefore, it is not necessary to improve the dimensional accuracy of the various parts, so that specific considerations to the accuracy of the die used for manufacturing the parts, arrangements of the terminals in the connector and selection of specific resin materials are not required, thereby simplifying quality control. In addition, when the connector is connected to the mating connector, terminals of each of the connectors can be easily connected within loss of operation efficiency which was found in the conventional ultra multi-pole connector. Further, since the number of terminals can be easily increased or decreased by changing the number of small size multi-pole connectors in accordance with the number of the terminals in the mating connector, it is possible to prevent the situation in which there are terminals which are not used for electrical connection.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. An ultra multi-pole connector adapted to be connected to a mating multi-pole connector having a plurality of terminals, which comprises:

a plurality of small size multi-pole connectors each having a connector housing in which a plurality of terminals connected to a plurality of wires are mounted, said terminals being adapted to be connected to said terminals of said mating connector;

a casing having a plurality of hollow sections in which said small size multi-connectors are inserted in an insertion direction and accommodated, respectively;

means for mounting each of said small size multi-pole connectors in said hollow sections in such a manner that said small size multi-pole connectors can be freely displaced relative to said hollow sections in a plane perpendicular to the insertion direction of said connectors and in such a manner that said connectors can be unremovably held in said hollow sections when said small size multi-pole connectors are accommodated in said hollow sections, whereby positional deviation between terminals of said small size multi-pole connectors and the mating connectors can be easily corrected by displacing said small size multi-pole connectors within said plane;

wherein said mounting means includes a shoulder member formed on said connective housing of each said small size multi-pole connector and a first and a second engagement member provided in each of said hollow sections, wherein each said shoulder member has a shape and a size such that each said small size multi-pole connector can be freely displaced in its respective said hollow section within the plane when the connector is accommodated in said hollow section, while said shoulder member is adapted to be held between said first and second engagement members so as not to be removed therefrom when said small size multi-pole connector is accommodated in said hollow section.

2. An ultra multi-pole connector, comprising:

a plurality of small size multi-pole connectors each having a connector housing in which a plurality of terminals connected to a plurality of wires are mounted, and each said connector housing having an upper portion;

a casing having longitudinal side walls and lateral side walls;

a plurality of hollow sections defined in said casing, in which said small size multi-pole connectors are inserted in an insertion direction and accommodated, respectively, and each of said hollow sections having opposite side walls having an upper portion, respectively;

a step portion provided between said hollow sections in said casing, said step portion having an upper surface which is positioned at a relatively lower position than the upper portion of the side walls of said hollow sections; and means for mounting each of said small size multi-pole connectors in said hollow sections in such a manner that said small size multi-pole connectors can be freely displaced in the plane perpendicular to the insertion direction of said connectors and in such a manner that said connectors can be unremovably held in said hollow sections when said small size multi-pole connectors are accommodated in said hollow sections, and said mounting means comprising:

first and second shoulder members formed on the upper portion of said connector housing of each said small size multi-pole connector;

a first engagement member formed on the upper portion of each said side wall of each said hollow section, and said first engagement member being adapted to abuttingly engage said first shoulder member when said small size multi-pole connectors are accommodated in said hollow sections; and a second engagement member formed on each said hollow section adapted to abuttingly engage said second shoulder member when said small size multi-pole connectors are accommodated in said hollow sections;

wherein said shoulder members and said engagement members act to retain said small size multi-pole connectors in their respective said hollow sections.

3. An ultra multi-pole connector as set forth in claim 2, wherein each of the lateral side walls of said casing has a notch, said connector housing of said small size multi-pole connectors has a substantially square upper plate having four edges, said first and second shoulder members include protrusions protruding from each edge in the horizontal direction at said upper plate, said first engagement member includes protrusions protruding inwardly from each upper portion of said side wall of said hollow section, and said second engagement member includes said upper surfaces of said step portions and said notches.

4. An ultra multi-pole connector as set forth in claim 3, wherein the distance between said first and second engagement members in the insertion direction is substantially equivalent to the thickness of said shoulder member of said small size multi-pole connector.

5. An ultra multi-pole connector as set forth in claim 2, wherein said second engagement member includes said upper surface of said step portion of said casing and said step portion has at least one projection, said second engagement shoulder has an aperture engageable with said projection, and said aperture has a sectional area larger than that of said projection, whereby said small size multi-pole connector is unremovably held in said hollow section by the engagement between said projection and aperture.

6. An ultra multi-pole connector, comprising:

a plurality of small size multi-pole connectors each having a connector housing in which a plurality of terminals connected to a plurality of wires are mounted, and each connector housing having an upper plate;

a casing having a plurality of hollow sections defined in said casing, and in said hollow sections said small size multi-pole connectors are inserted in an insertion direction and accommodated, respectively, and each of said hollow sections having opposite side walls having an upper portion;

means for mounting each of said small size multi-pole connectors in said hollow sections in such a manner that said small size multi-pole connector can be freely displaced in the plane perpendicular to the insertion direction of said connector and in such a manner that said connector can be removably held in said hollow section when said small size multi-pole connector is accommodated in said hollow section, and said mounting means comprising:

a flanged shoulder member formed on said upper plate, said upper plate having a shape and size such that said plate is adapted to be displaced within said plane when said small size multi-pole connector is accommodated in said hollow section;

a first engagement member formed on the upper portion of said hollow section; and a second engagement member provided on said side walls of said hollow section, and said second engagement member being positioned slightly below said first engagement member, whereby said shoulder member is displaceably engaged between said first and second engagement members when said small size multi-pole connector is accommodated in said hollow section.

7. An ultra multi-pole connector as set forth in claim 6, wherein the distance between said first and second engagement members is substantially equivalent to the thickness of the shoulder member.

8. An ultra multi-pole connector as set forth in claim 6, wherein said second engagement member includes two pieces, and each of said pieces is wedged shape in cross section to facilitate the insertion of the upper plate between the first and second engagement members.

9. An ultra multi-pole connector as set forth in claim 8, wherein a slot through which the wires connected to the small size connector are passed is provided on each hollow section.

* * * * *